US006105790A

United States Patent [19]

Parks

[11] Patent Number: 6,105,790

[45] Date of Patent: Aug. 22, 2000

[54] BOOK STORAGE AND LEARNING CENTER

[76] Inventor: Stephen Alan Parks, 295 SW. Brushy Mound Rd., Burleson, Tex. 76028-3326

[21] Appl. No.: 09/385,361

[22] Filed: Aug. 30, 1999

[51] Int. Cl.[7] ..... A47F 5/00

[52] U.S. Cl. ..... 211/42; 211/89.01; 273/157 R

[58] Field of Search ..... 211/42, 40, 87.01, 211/89.01; 273/156, 157 R

[56] References Cited

U.S. PATENT DOCUMENTS

| | | | |
|---|---|---|---|
| D. 218,242 | 8/1970 | Gompes . | |
| D. 218,248 | 8/1970 | Gompes . | |
| D. 366,504 | 1/1996 | Bannick . | |
| 3,815,920 | 6/1974 | Carter et al. | 273/157 R |
| 4,063,369 | 12/1977 | Hart . | |
| 4,487,585 | 12/1984 | Goldwasser | 273/156 X |
| 4,543,278 | 9/1985 | Ackerman . | |
| 5,284,256 | 2/1994 | Correll-Atoun . | |
| 5,540,609 | 7/1996 | Hoag . | |
| 5,628,513 | 5/1997 | Soriano | 273/157 R |
| 5,823,532 | 10/1998 | Goldwasser | 273/157 R |

*Primary Examiner*—Robert W. Gibson, Jr.
*Attorney, Agent, or Firm*—Dowell & Dowell, P.C.

[57] ABSTRACT

A combination book organizer and learning center which includes a body having a plurality of pockets of predetermined and varying shapes formed therein in which books having the same predetermined varied shapes are placed when not in use.

18 Claims, 2 Drawing Sheets

BOOK STORAGE AND LEARNING CENTER

BACKGROUND OF THE INVENTION

1. Field of the Invention

The present invention is generally directed to the field of bookshelves for children's books and more particularly to a book organizer unit which functions both as a wall display as well as a child's learning center. The invention further relates to an organizer unit for books which includes a plurality of pockets having varying configurations in which books having similar configurations are retained. The storage unit functions as a shelf or display stand which neatly displays books of interest to a child and which also stimulates a child's interest in replacing books which have been removed by creating a puzzle-like display wherein the books can be matched with the configuration of the pockets thus functioning as a child's learning center as well as a shelving unit.

2. Brief Discussion of the Related Art

The early development of a child's reading habits can be extremely beneficial in the child's learning and understanding capabilities. In this respect, numerous books have been published to capture the imagination of different age groups of children in order to stimulate their desire to handle, play with and eventually read the material of such books. To make books appear more interesting, it has been known to configure the shape of books to resemble different animate and inanimate objects, such that the books function both as a toy as well as reading material.

Another manner in which to stimulate a child's interest in reading materials is to provide for a proper display of such materials. There have been a number of innovations made which are directed to providing shelving or bookcases particularly adapted for use in displaying children's books. By way of example, in U.S. Pat. No. 5,284,256 to Correll-Antoun, a child's book stand is disclosed which is particularly constructed so as to display the front cover portion of the books support thereon to children in order to stimulate their interest to select books from the stand. Although the book stand disclosed in the patent facilitates a child's selecting a book from the stand, there is no other interaction created between the stand and the child and, thus, once a book is selected from the stand, there is nothing related to the shelf which draws the attention of a child with the exception of selecting other books. In many instances a child may select a number of books from such a display stand and not replace the books, thereby requiring an adult to replace books which have been removed so that the books will again be displayed to stimulate the interest of the same or another child.

In view of the foregoing, there is a need to provide for a display stand or other storage unit for use with children's books which not only stimulates a child's desire to select books, but also which functions as an interactive teaching resource for further developing a child's mind. Also, there is a need to provide a bookcase or book display unit which also functions to encourage the replacement of books by children once the have finished utilizing a book such that books associated with the display unit are normally readily available for selection, not only to one child, but to several children in a room or in a learning area. An example of display for use with children's toys and which is designed to stimulate a child's interest in returning toys to a storage area is disclosed in U.S. Pat. No. 4,543,278 to Ackerman.

SUMMARY OF THE INVENTION

The present invention is directed to a combination book display stand, organizer and learning center which includes a body having a plurality of spaced pockets formed therein in which books are selectively received. In a preferred embodiment, the pockets have varying configurations which match the configurations of the books which are seated within the pockets.

In one embodiment of the present invention, the body of the organizer unit is formed of a molded plastic material and the inner surface of each pocket has displayed thereon an image which directly relates to the book which is normally stored in the pocket. To further facilitate the removal of books from the pockets of the organizer unit, recesses are provided adjacent to and in communication with each pocket. The recesses allow an individual to insert a finger or thumb to withdraw one edge of a book to facilitate it's removal from a pocket.

In a preferred embodiment of the invention, the body is formed as a generally vertical panel which is designed to be secured to a vertical surface such as a wall. The panel may be in the configuration of a tree having a base which extends from adjacent a floor to a canopy portion in which the pockets for receiving the books are formed.

It is the primary object of the present invention to provide a display and organizer unit for books wherein the unit also provides a learning center for use by children and which aesthetically draws the attention of a child to books retained in the unit.

It is also an object of the present invention to provide a children's bookshelf organizer and learning center wherein the organizer is in the form of a tree and wherein the books function as the "fruit" of the tree such that when "picked" or removed from the tree, the books provide educational nourishment for children.

It is a further object of the present invention to provide a book display and organizer which functions in the manner of a puzzle with the puzzle pieces being the books such that a child must be able to match the configuration of a book with a particular pocket in order for the book to be properly seated for display whereby the organizer is useful as a learning tool.

It is another object of the present invention to provide a display and organizer for children's books which includes a plurality of spaced pockets formed therein wherein images or figures are associated with each pocket and which images or figures relate directly to the subject matter, images or figures disclosed in the books such that a child must place a book having a particular image associated therewith in a pocket having related images or configurations associated therewith.

It is yet another object of the present invention to provide an organizer for books which is designed to stimulate the desire of a child to replace books which have been removed therefrom by forming the organizer to function as a puzzle in which pieces, formed as books, are placed in appropriate pockets depending upon shape, size, or related indicia associated with the pockets.

It is yet another object of the invention to provide a bookshelf organizer that teaches children organizational skills and which also functions to educate them in shape and character identification and recognition.

BRIEF DESCRIPTION OF THE DRAWINGS

A better understanding of the invention will be had with respect to the drawing figures wherein.

DESCRIPTION OF THE PREFERRED EMBODIMENT

Figure 1:
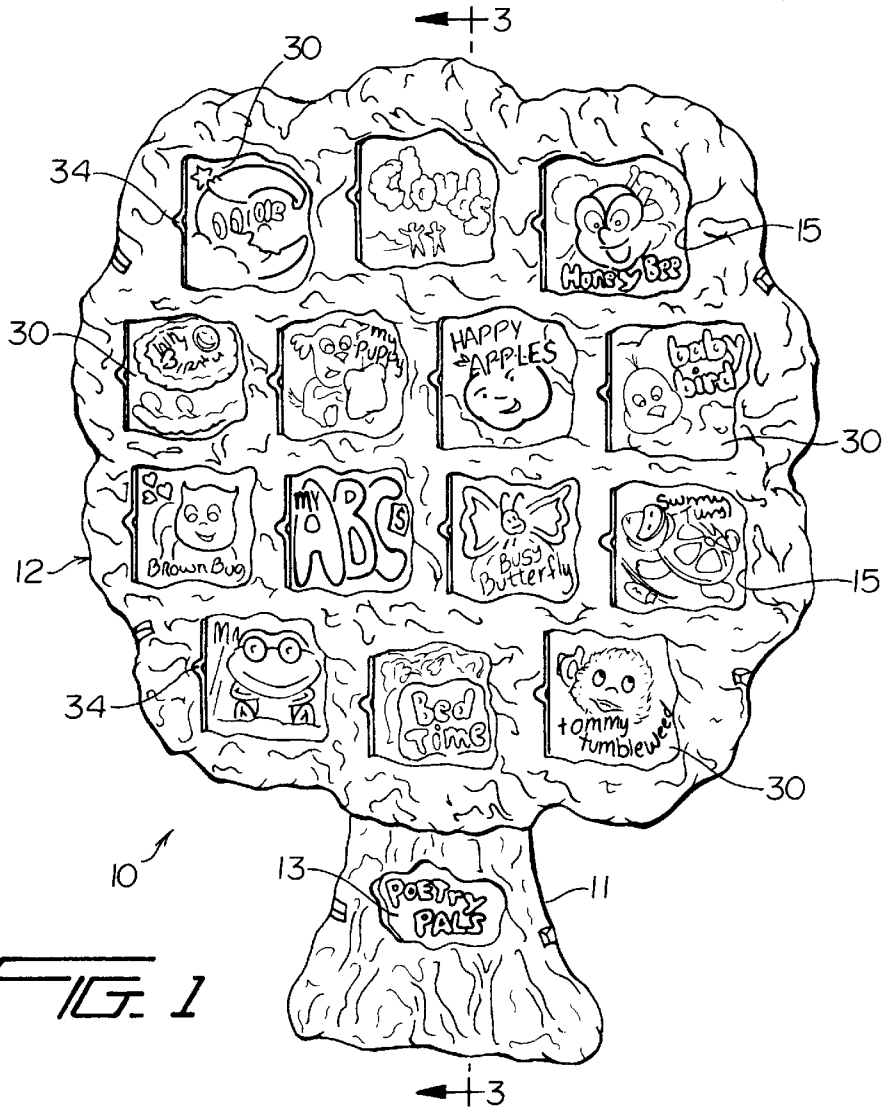
FIG. 1 is a front perspective view of the invention showing a plurality of books seated in pockets of the display organizer.
Figure 2:
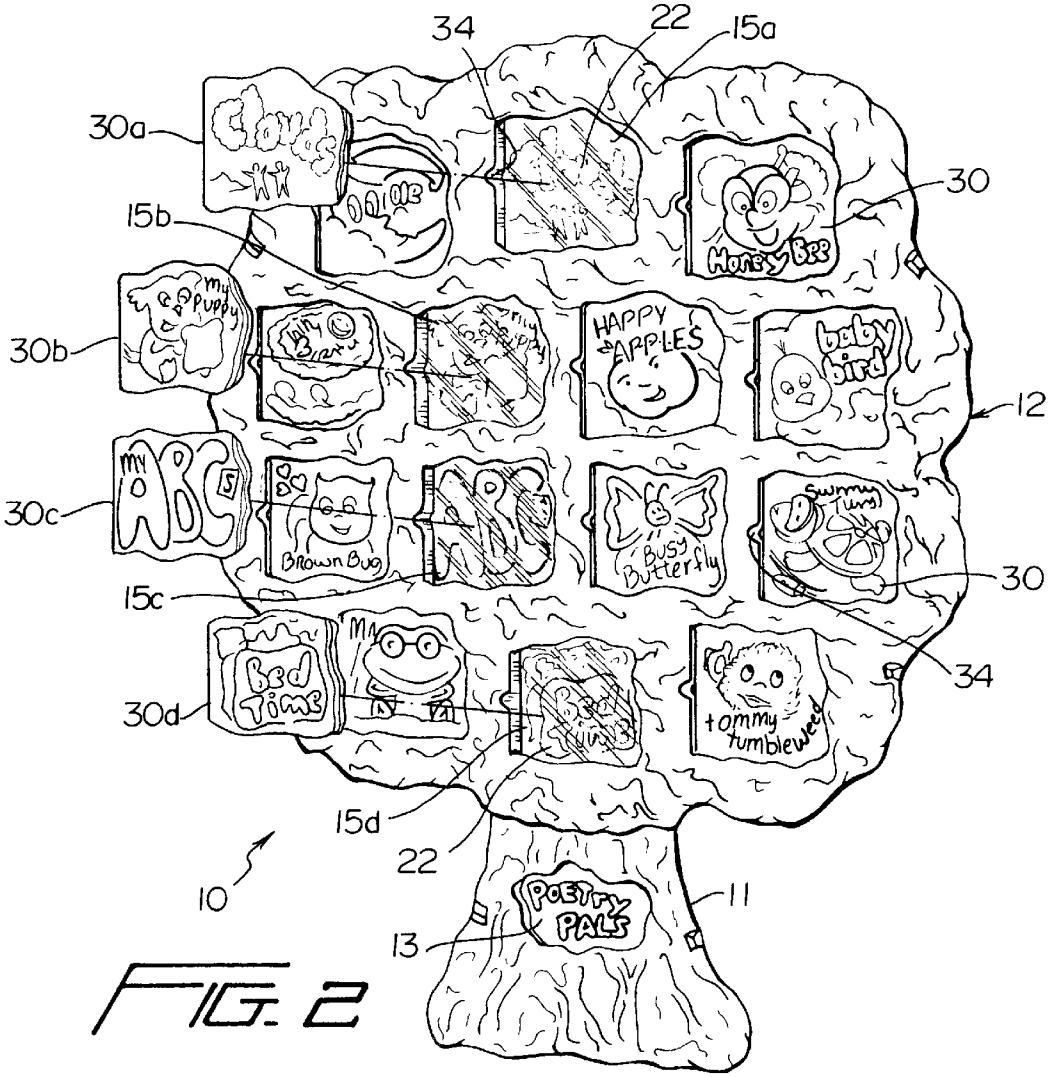
FIG. 2 is a view similar to FIG. 1 showing a plurality of the books being removed from shelf pockets and showing the cooperative configuration of the pockets as they relate to the books.

With continued reference to the drawing figures, the bookshelf or book display organizer 10 of the present invention is shown in drawing FIGS. 1 and 2 as being formed of a high impact plastic material such as polystyrene which has been vacuum molded. The organizer may be formed of other materials and be within the teachings of the present invention. As shown, the organizer is in the form of a tree having a simulated trunk 11 and canopy 12 which serve as the base and the body, respectively, of the organizer. The base or trunk may include a central area 13 in which a trademark identifying the organizer may be molded. It should be noted that other configurations for the bookshelf organizer may be utilized and be within the teachings of the present invention.

The body 12 of the organizer includes a plurality of integrally molded recesses or pockets 15 which are spaced relative to one another. In the preferred embodiment, the outer walls defining the periphery of each pocket vary in configuration such that the overall area, shape or configuration of each pocket differs from that of other pockets. In some embodiments it is possible that some of the pockets 15 will have the same configuration, however, in other embodiments, each of the pockets will be varied in configuration. Further, the rear walls 18 defined by each pocket include an inner surface on which indicia or stickers 22 are placed for purposes of which will be described in greater detail hereinafter. The indicia may also be provided in the form of a molded symbol, character or other representation as opposed to a separately applied sticker or other applied written or visual indicia.

Figure 3:
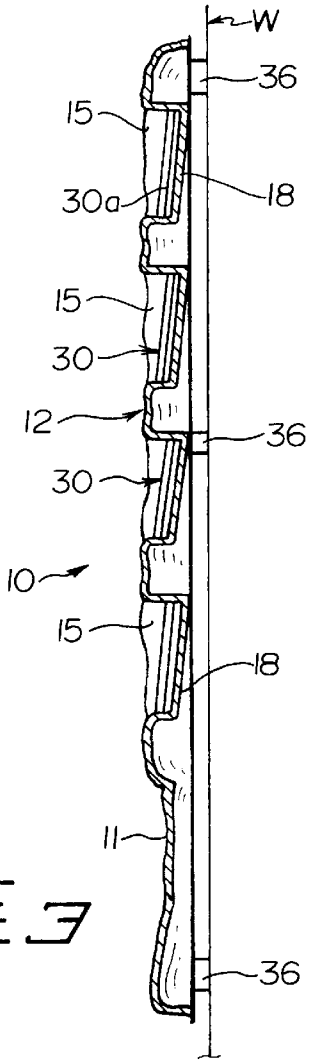
FIG. 3 is a cross sectional view taken along line 3—3 of FIG. 1.

With specific reference to FIG. 3, the rear wall 18 of each pocket is inclined from the front face 24 of the body of the organizer toward the rear surface 26 thereof. The degree of incline of the rear wall will depend upon the size and thickness of books 30 which are designed to be received within the pockets 15. The inclination of the rear walls is provided so that the books 30 will not readily be displaced by accidently falling from the pockets 15. It should be noted that the books are also of varying shapes or configurations and, in the preferred embodiment, each of the books is of a configuration to be cooperatively received within one of the pockets 15. Thus, as shown by example in FIG. 2, book 30*a*, having the title of "Clouds", has an outer configuration such that it is cooperatively received in pocket 15*a* whereas book 30*b* has a different outer configuration which is designed to allow the book to be cooperatively seated within the pocket 15*b*. In a like manner book 30*c* has yet a different configuration which is compatible and cooperates with the configuration of the pocket 15*c* while book 30*d* has a configuration to be seated in pocket 15*d* formed in the body 12 of the bookshelf organizer.

A major theme of the present invention is to utilize the books associated with the organizer such that the books are the "fruit" of the tree. By picking the "fruit" a child may be mentally enhanced and rewarded with the educational benefits of the books which form the fruit of the tree. By varying the subject matter of the books associated with the organizer, various educational subjects are presented to children in an enticing manner.

From the foregoing, the bookshelf organizer of the present invention not only provides for a storage and display shelf for the books 30 but the pockets 15 also function as a puzzle base to develop skills in shape identification and physical dexterity. Therefore, after a child removes a book from the organizer, a child must determine into which pocket the book is properly returned. The organizer thus functions as a toy for developing shape recognition and other motor skills. Further, because a child is required to identify the shapes of the books relative to the shape of the pockets, the child is induced to play with the books in order to solve the puzzle.

To further enhance the educational aspects of the shelf organizer of the present invention, the indicia, stickers or other symbols 22 utilized along the rear walls of each pocket may include a picture or symbol associated with the particular book which is to be retained within that pocket. As shown, the book 30*a* designates a story about clouds and pictures of clouds are shown or the word "cloud" is shown in the pocket 15*a*. Book 30*b* is a book about a puppy and therefore a picture or image of a puppy is provided on the rear surface of pocket 15*b* whereas book 30*c* is a story about the alphabet and letters of the alphabet are shown in the surface of the rear wall of the pocket 15*c*. Book 30*d* includes a story about bedtime and thus pocket 15*d* includes indicia of a bed. The relationship between the symbols or indicia utilized on the rear walls of the pockets and the stories of the books also further develops an interaction between a child and the bookshelf organizer which further enhances recognition and organizational skills.

It should be noted that the number of pockets may be varied. Although fourteen pockets are shown in the drawing figures for fourteen separate books, any number of books and pockets may be utilized and be within the teachings of the present invention. To further facilitate the manipulation or removal of the books from the pockets, recesses 34 are provided in open communication along a portion of the edge of each pocket. The recesses 34 are designed to permit the insertion of an individual's finger or thumb to thereby allow an edge of the book to be engaged to facilitate removal of a book from a pocket.

The present invention is designed to provide for space saving storage and display of the books 30. In this respect, and as shown in FIG. 3, the bookshelf organizer, in a preferred embodiment, is designed to be mounted vertically against a wall "W" and secured thereto by appropriate fasteners which may be screws. In the drawing figures, adhesive pads 36 are shown for securing the organizer to the surface of the wall. It is envisioned that in some embodiments of the invention, the bookshelf organizer may be free standing and have opposing sides each of which includes a plurality of pockets therein for the retention of additional books.

As previously discussed, the present invention not only stimulates a child's desire to read by providing a vary visually pleasing and interactive manner for retaining and displaying books, but the organizer also teaches children organizational skills as well as shape identification skills by providing an interactive puzzle-like device in which various shaped books must be placed into the proper pockets in order for the books to be properly stored. Further, by using indicia or other shapes with each of the pockets which relate to the stories in the books, a child's reasoning and develop recognition skills are further developed. Also, because of the interest which is created by the present invention, children are also taught to replace books which they have used in the proper position on the organizer thus learning the value of returning toys and books to their appropriate storage space. Because of the varying configurations associated with the books, the books also may function as toys. In this respect, the configuration of each of the books may also be in geometrical shapes or in the shapes of animate and inanimate objects. For instance, the books may be in the shape of a star, a circle, a square, a hexagon, a trapezoid, a triangle, a dog, a cat, a turtle, an alligator, a truck, a car, a plane, a computer and so on thus further expanding the possible educational purposes for which the present invention may be used.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A book organizer for supporting and displaying a plurality of books, the organizer comprising;

a body, a plurality of pockets formed in said body in spaced relationship to one another, at least two of said pockets having predetermined shapes of differing configurations, each of said at least two pockets being adapted to receive a book having one of said predetermined shapes therein, and each of said pockets including a rear wall which is inclined from a base of the pocket to an upper edge of the pocket.

2. The book organizer of claim 1 wherein said body is formed of a plastic material and said pockets are integrally formed therein.

3. The book organizer of claim 1, including a recess in said body adjacent to each of said pockets whereby said recesses facilitate the removal of books from said pockets.

4. The book organizer of claim 3 including means for securing said body to a vertically extending surface.

5. The book organizer of claim 1 in which at least one of said pockets includes indicia on said rear wall thereof which relates to a story of a book.

6. The book organizer of claim 1 in which said body is in the configuration of a canopy of a tree, and a base extending from said canopy in the configuration of a trunk of a tree.

7. The book organizer of claim 6 including means for securing said body to a vertically extending surface.

8. A book organizer and educational device for supporting a plurality of books comprising;

a body, a plurality of pockets formed in said body in spaced relationship to one another, at least two of said pockets having predetermined shapes of differing configurations, a plurality of books, each of said books having a shape to be cooperatively seated within one of said plurality of pockets whereby when said books are not in use, they are placed within said pockets with said books only being receivable in pockets of a similar configuration.

9. The book organizer and educational device of claim 8 wherein said body is formed of a plastic material and said pockets are integrally formed therein.

10. The book organizer of claim 9 in which each of said pockets includes a rear wall which is inclined from a base of the pocket to an upper edge of the pocket.

11. The book organizer of claim 9, including a recess in said body adjacent to each of said pockets whereby said recesses facilitate the removal of books from said pockets.

12. The book organizer of claim 9 in which at least one of said pockets includes indicia on said rear wall thereof which relates to a story of a book.

13. The book organizer of claim 9 in which said body is in the configuration of a canopy of a tree, and a base extending from said canopy in the configuration of a trunk of a tree.

14. The book organizer of claim 9 including means for securing said body to a vertically extending surface.

15. A book organizer for supporting and displaying a plurality of books, the organizer comprising;

a body, a plurality of pockets formed in said body in spaced relationship to one another, said pockets having shapes of differing configurations;

a plurality of books having shapes of differing configurations which are similar to the differing configurations of said pockets such that said books are cooperatively seated in pockets of a similar configuration when stored in the organizer.

16. The book organizer of claim 15, including a recess in said body adjacent to each of said pockets whereby said recesses facilitate the removal of said books from said pockets.

17. The book organizer of claim 15 in which each of said pockets includes a rear wall which is inclined from a base of the pocket to an upper edge of the pocket.

18. The book organizer of claim 15 in which each of said pockets includes indicia on a rear wall thereof which indicia relates to a story of a book having a similar configuration of the pocket and which book is receivable within the pocket.

* * * * *